US011394104B2

(12) United States Patent
Min

(10) Patent No.: US 11,394,104 B2
(45) Date of Patent: Jul. 19, 2022

(54) PRINTED CIRCUIT BOARD AND ANTENNA MODULE COMPRISING THE SAME

(71) Applicant: SAMSUNG ELECTRO-MECHANICS CO., LTD., Suwon-si (KR)

(72) Inventor: Tae Hong Min, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 17/068,304

(22) Filed: Oct. 12, 2020

(65) Prior Publication Data

US 2021/0399408 A1 Dec. 23, 2021

(30) Foreign Application Priority Data

Jun. 22, 2020 (KR) ..... 10-2020-0075694

(51) Int. Cl.

| | |
|---|---|
| ***H01Q 1/22*** | (2006.01) |
| ***H01Q 1/42*** | (2006.01) |
| ***H01Q 1/38*** | (2006.01) |
| ***H01Q 1/24*** | (2006.01) |

(52) U.S. Cl.

CPC ..... *H01Q 1/2283* (2013.01); *H01Q 1/243* (2013.01); *H01Q 1/38* (2013.01); *H01Q 1/427* (2013.01)

(58) Field of Classification Search

CPC ..... H01Q 1/2283; H01Q 1/38; H01Q 1/243; H01Q 1/427

See application file for complete search history.

(56) References Cited

U.S. PATENT DOCUMENTS

| | | | | |
|---|---|---|---|---|
| 2010/0190334 | A1* | 7/2010 | Lee | H01L 24/24 438/637 |
| 2019/0372229 | A1 | 12/2019 | Dalmia et al. | |
| 2020/0014090 | A1 | 1/2020 | Jung et al. | |
| 2020/0178401 | A1* | 6/2020 | Min | H05K 3/4691 |

FOREIGN PATENT DOCUMENTS

| | | | | |
|---|---|---|---|---|
| EP | 1167281 | A2 * | 1/2002 | H01L 24/81 |
| KR | 10-2020-0005950 | A | 1/2020 | |
| KR | 10-2066903 | B1 | 1/2020 | |

* cited by examiner

*Primary Examiner* — Hoang V Nguyen

(74) *Attorney, Agent, or Firm* — Morgan, Lewis & Bockius LLP

(57) ABSTRACT

The present disclosure relates to a printed circuit board. The printed circuit board includes: a first substrate portion having a rigid region and a flexible region; and a second substrate portion disposed on the first substrate portion. The first substrate portion and the second substrate portion are disposed to be shifted such that portions of each of the first substrate portion and the second substrate portion overlap each other.

20 Claims, 12 Drawing Sheets

PRINTED CIRCUIT BOARD AND ANTENNA MODULE COMPRISING THE SAME

CROSS-REFERENCE TO RELATED APPLICATION(S)

This application claims benefit of priority to Korean Patent Application No. 10-2020-0075694 filed on Jun. 22, 2020 in the Korean Intellectual Property Office, the disclosure of which is incorporated herein by reference in its entirety.

TECHNICAL FIELD

The present disclosure relates to a printed circuit board and an antenna module comprising the same.

BACKGROUND

Recently, with the introduction of 5G mobile communications technology, a technology for reducing signal transmission loss in the high frequency region has been under development. Accordingly, an antenna in a high-frequency band is additionally required, the number of antennas to be included in electronic devices is increasing, and a design method to efficiently utilize a space inside the electronic devices is required.

SUMMARY

An aspect of the present disclosure is to provide a printed circuit board capable of overcoming space limitations in the interior of electronic devices.

Another aspect of the present disclosure is to provide a printed circuit board capable of minimizing signal transmission loss.

Another aspect of the present disclosure is to provide a printed circuit board capable of reducing costs and/or increasing convenience of a process.

Another aspect of the present disclosure is to provide an antenna module capable of miniaturizing a product.

Another aspect of the present disclosure is to provide an antenna module capable of minimizing signal transmission loss.

Another aspect of the present disclosure is to provide an antenna module capable of reducing costs and/or increasing convenience of a process.

According to an aspect of the present disclosure, a printed circuit board includes: a first substrate portion having a rigid region and a flexible region; and a second substrate portion disposed on the first substrate portion. The first substrate portion and the second substrate portion are disposed to be shifted such that portions of each of the first substrate portion and the second substrate portion overlap each other.

According to an aspect of the present disclosure, an antenna module includes: a first substrate portion having a rigid region and a flexible region; a second substrate portion disposed on the first substrate portion; and an antenna disposed on the second substrate portion. The first substrate portion and the second substrate portion are disposed to be shifted such that portions of each of the first substrate portion and the second substrate portion overlap each other, and the antenna is disposed on an opposite side of a side of the second substrate portion, facing the first substrate portion.

According to an aspect of the present disclosure, an antenna module includes: a first substrate portion having a rigid region and a flexible region extending from the rigid region; a second substrate portion including a first region disposed on the rigid region and a second region extending from the first region; a connection portion connecting the rigid region of the first substrate portion and the first region of the second substrate portion to each other, the second region of the second substrate portion and the flexible region of the first substrate being disposed on opposing sides of the connection portion; and an antenna disposed on the first region of the second substrate portion.

DETAILED DESCRIPTION

Figure 1:
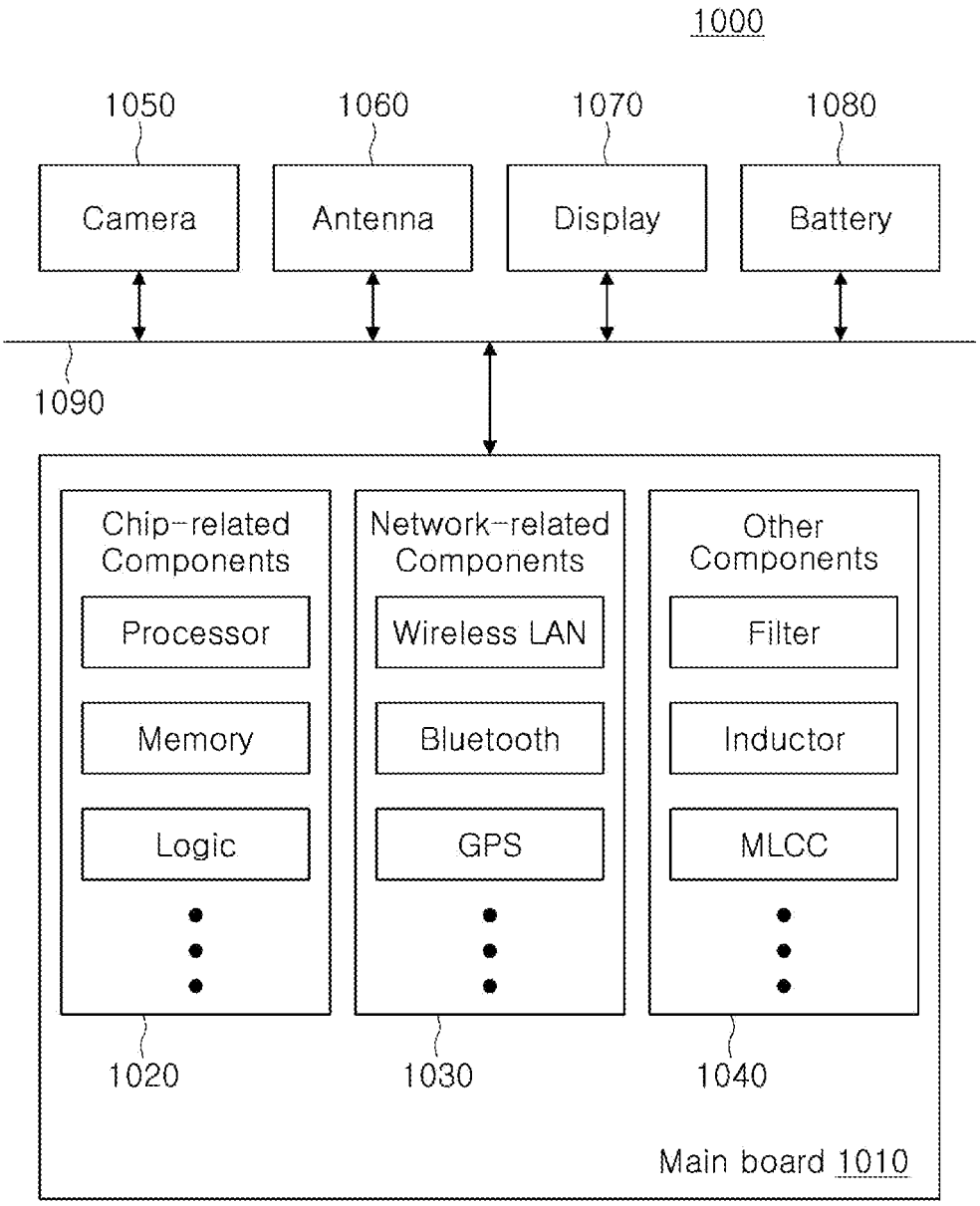
FIG. 1 is a block diagram schematically illustrating an example of an electronic device system.

Hereinafter, the present disclosure will be described with reference to the accompanying drawings. Shape and size of the elements in the drawings may be exaggerated or reduced for more clear description.

Electronic Device

FIG. 1 is a schematic view illustrating an example of a block diagram of an electronic device system according to an example.

Referring to FIG. 1, an electronic device 1000 may receive a main board 1010. The main board 1010 may include chip related components 1020, network related components 1030, other components 1040, or the like, physically or electrically connected thereto. These components may be connected to others to be described below to form various signal lines 1090.

The chip associated components 1020 may include a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital converter, an application-specific integrated circuit (ASIC), or the like, or the like. However, the chip associated components 1020 are not limited thereto, and may include other types of chip associated components. In addition, the chip-associated components 1020 may be combined with each other.

The network associated components 1030 may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+ (HSPA+), high speed downlink packet access+ (HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth®, 3G, 4G, and 5G protocols, and any other wireless and wired protocols, designated after the abovementioned protocols. However, the network associated components 1030 are not limited thereto, and may also include a variety of other wireless or wired standards or protocols. In addition, the network associated components 1030 may be combined with each other, together with the chip associated components 1020 described above.

Other components 1040 may include a high frequency inductor, a ferrite inductor, a power inductor, ferrite beads, a low temperature co-fired ceramic (LTCC), an electromagnetic interference (EMI) filter, a multilayer ceramic capacitor (MLCC), or the like. However, other components 1040 are not limited thereto, but may also include passive components used for various other purposes, or the like. In addition, other components 1040 may be combined with each other, together with the chip related components 1020 or the network related components 1030 described above.

Depending on a type of the electronic device 1000, the electronic device 1000 includes other components that may or may not be physically or electrically connected to the main board 1010. These other components may include, for example, a camera 1050, an antenna 1060, a display 1070, a battery 1080, an audio codec (not illustrated), a video codec (not illustrated), a power amplifier (not illustrated), a compass (not illustrated), an accelerometer (not illustrated), a gyroscope (not illustrated), a speaker (not illustrated), a mass storage unit (for example, a hard disk drive) (not illustrated), a compact disk (CD) drive (not illustrated), a digital versatile disk (DVD) drive (not illustrated), or the like. However, these other components are not limited thereto, but may also include other components used for various purposes depending on a type of electronic device 1000, or the like.

The electronic device 1000 may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like. However, the electronic device 1000 is not limited thereto, and may be any other electronic device able to process data.

Figure 2:
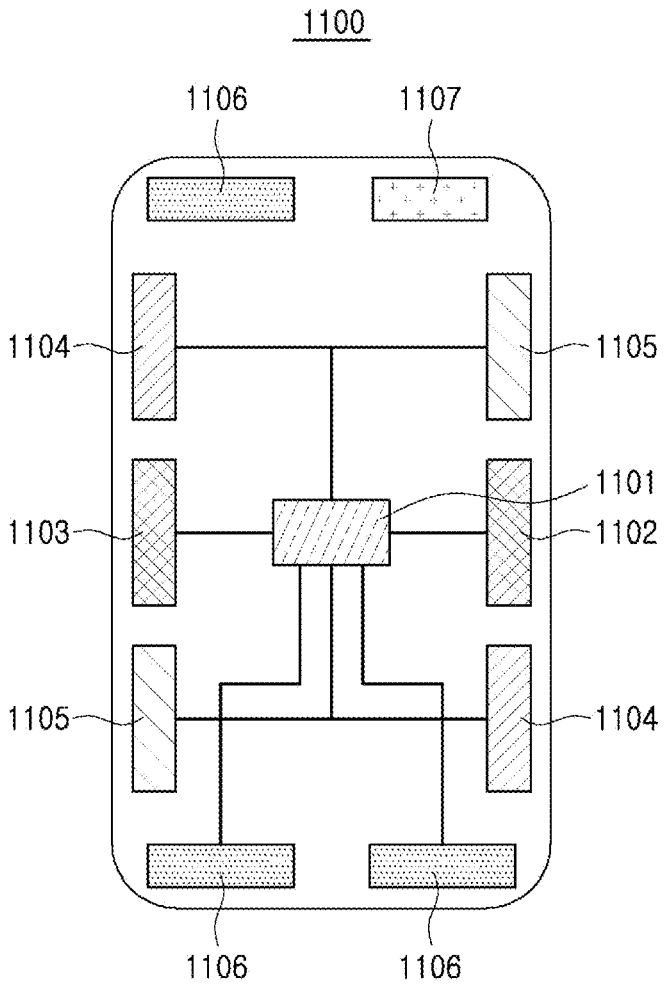
FIG. 2 is a perspective view schematically illustrating an example of an electronic device.

FIG. 2 is a schematic perspective view of an electronic device according to an example.

Referring to FIG. 2, an electronic device may be, for example, a smartphone 1100. Various types of antenna modules 1102, 1103, 1104, 1105, and 1106 connected to a modem 1101 may be disposed through the modem 1101, a rigid printed circuit board, a flexible printed circuit board, and/or a rigid flexible printed circuit board inside the smartphone 1100. If necessary, a Wi-Fi module 1107 may also be disposed. The antenna modules 1102, 1103, 1104, 1105, and 1106 may include antenna modules 1102, 1103, 1104, and 1105 of various frequency bands for 5G mobile communication, for example, an antenna module 1102 for a 3.5 GHz band frequency, an antenna module 1103 for a 5 GHz band frequency, an antenna module 1104 for a 28 GHz band frequency, an antenna module 1105 for a 39 GHz band frequency, and the like, and other 4G antenna module 1106. However, it is not limited thereto. Meanwhile, the electronic device is not necessarily limited to the smartphone 1100, and may be other electronic devices as described above.

Printed Circuit Board and Antenna Module

Figure 3:
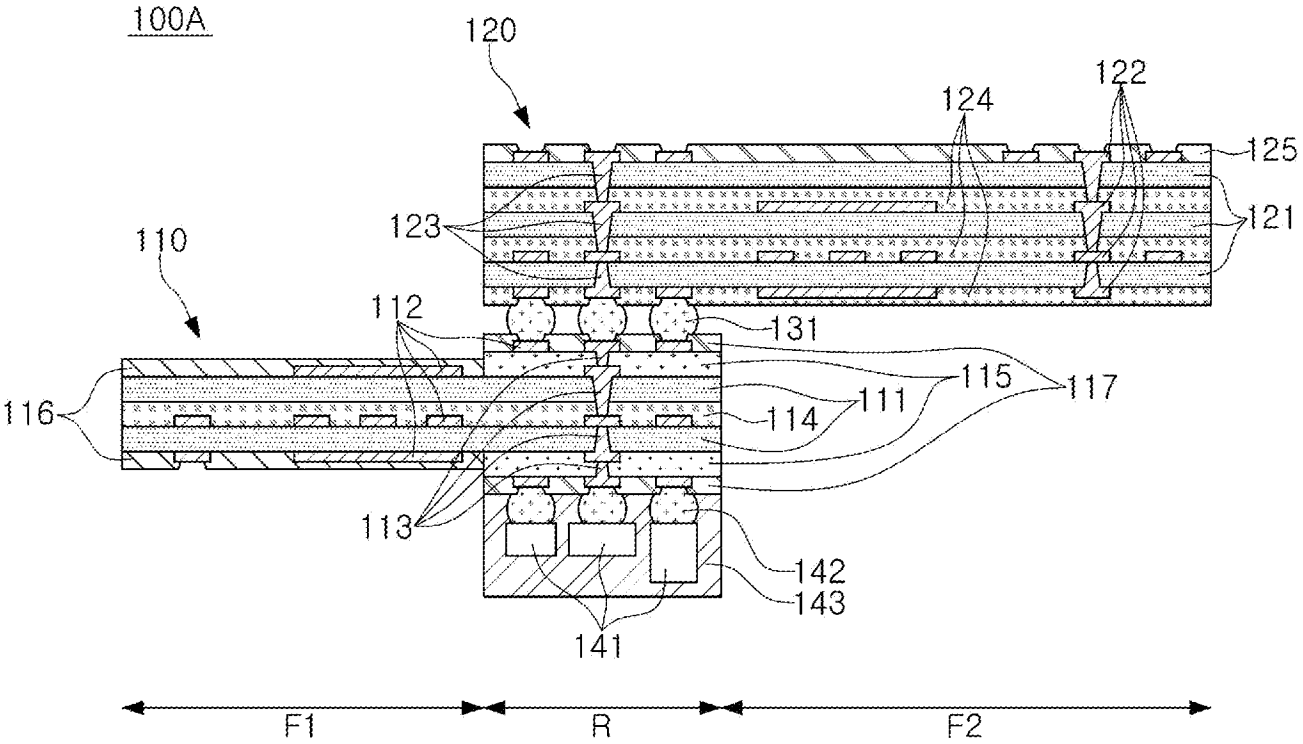
FIG. 3 is a cross-sectional view schematically illustrating an example of a printed circuit board according to the present disclosure.

FIG. 3 is a cross-sectional view illustrating an example of a printed circuit board 100A according to the present disclosure.

Referring to FIG. 3, the printed circuit board 100A according to an example includes a first substrate portion 110 having a rigid portion R and a flexible region F1 and a second substrate portion 120 disposed on the first substrate portion 110. The first substrate portion 110 and the second substrate portion 120 may be connected to each other through a first connection conductor 131.

In addition, the printed circuit board 100A according to an example may further include an electronic component 141 disposed on the first substrate portion 110. The electronic component 141 may be disposed on the rigid region R of the first substrate portion 110, and may be disposed on an opposite side of a side on which the second substrate portion 120 of the rigid region R of the first substrate portion 110 is disposed. The electronic component 141 may be disposed on the first substrate portion 110 through a second connection conductor 142 to be covered with an encapsulant 143.

Meanwhile, the first substrate portion 110*a* and the second substrate portion 120 are disposed to be shifted (or offset), such that portions of each of the first substrate portion 110 and the second substrate portion 120 overlap each other. In this case, as shown in FIG. 3, the portion of the second substrate portion 120 may overlap the rigid region R of the first substrate portion 110. When the second substrate portion 120 has a region overlapping the rigid region R of the first substrate portion 110, a region of the second substrate portion 110, other than the region overlapping the first substrate portion 110, may be flexible. In one example, a first region of an element A and a second region of an element B overlapping each other may mean that the first region of the element A being disposed on or below the second region of the element B in a stacking direction of the element A and the element B, so that the first region of the element A and the second region of the element B may overlay with each other in a plan view perpendicular to the stacking direction of the element A and the element B. In one example, a third region of an element A and a second region of an element B not overlapping each other, or the element A and the element B being shifted or offset from each other may mean that the element A having a region, for example, the third region, and the element B having a region, for example, the second region, may not overlay with each other in a plan view perpendicular to the stacking direction of the element A and the element B. In another example, an element A and an element B being shifted or offset from each other may mean that a side surface of the element A may not be aligned with any side surfaces of the element B or a side surface of the element B may not be aligned with any side surfaces of the element A. In one example, two surface being aligned may means that the two surfaces are disposed on a same plane or are flush with each other, with or without consideration of manufacturing or measurement errors. In one example, a side surface of an element may refer to a surface crossing or intersect by a main surface of the element.

In the present specification, the flexible regions F1 and F2 refer to regions having a characteristic that is relatively more easily bent or folded than the rigid region R. The rigid region R refers to a region having a characteristic that is relatively more easily bent or folded than the flexible regions F1 and F2, and it is not interpreted as a region having a characteristic that may not be bent or folded.

The first substrate portion 110 may include a first insulating layer 111 extending and disposed in the flexible region F1 and the rigid region R, a second insulating layer 115 disposed on the first insulating layer 111 in the rigid region R, a first wiring layer 112 disposed on the first insulating layer 111 and the second insulating layer 115, respectively, and a first via layer 113 penetrating through the first insulating layer 111 and/or the second insulating layer 115 to connect the first wiring layers 112 disposed on different layers to each other. Accordingly, the flexible region F1 of the first substrate portion 110 may include the first insulating layer 111, the first wiring layer 112, and the first via layer 113, and the rigid region R thereof may include the first insulating layer 111, the second insulating layer 115, the first wiring layer 112, and the first via layer 113. Meanwhile, the second insulating layer 115 may be disposed on both sides of the first insulating layer 111 as shown in the drawing, and, as illustrated in the drawing, may only be disposed on one surface of the first insulating layer 111.

Meanwhile, as illustrated in the drawing, the first insulating layer 111 may be a plurality of first insulating layers 111, and the first wiring layer 112 disposed on each of the plurality of first insulating layers 111 may be a plurality of first wiring layers. In this case, the printed circuit board 100A according to an example may further include a first bonding layer 114 disposed between the plurality of first insulating layers 111, and the first bonding layer 114 may cover a first wiring layer 112 disposed between the plurality of first insulating layers 111. In addition, the first via layer 113 connecting the plurality of first wiring layers 112 disposed on each of the plurality of first insulating layers 111 may penetrate through the first insulating layer 111 to penetrate through the first bonding layer 114.

The first substrate portion 110 may further include a cover lay 116 disposed on the first insulating layer 111 in the flexible region F1 to cover the first wiring layer 112. In this case, the first wiring layer 112 covered with the cover lay 116 may be a first wiring layer 112 disposed on an outermost layer in the flexible area F1 of the first substrate portion 110.

In addition, the first substrate portion 110 may further include a first protective layer 117 disposed on the second insulting layer 115 in the rigid region R to cover the first wiring layer 112. In this case, the first wiring layer 112 covered with the first protective layer 117 may be a first wiring layer 112 disposed on an outermost layer in the rigid region R of the first substrate portion 110.

The second substrate portion 120 may include a second via layer 123 connecting the third insulating layer 121, the second wiring layer 122 disposed on the third insulating layer 121, and the second wiring layer 122 penetrating through the third insulating layer 121 and disposed on different layers from each other, to each other.

Meanwhile, as illustrated in the drawing, the third insulating layer 121 may be a plurality of third insulating layers 121, and the second wiring layer 122 disposed on each of the plurality of third insulating layers 121 may be a plurality of second wiring layers 122. In this case, the printed circuit board 100A according to an example may further include a second bonding layer 124 disposed between the plurality of third insulating layers 121, and the second bonding layer 124 may cover a second wiring layer 122 disposed between the plurality of third insulating layers 121. In addition, a second via layer 123 connecting the plurality of second wiring layers 122 disposed on each of the plurality of third insulating layers 121 to each other may penetrate through the third insulating layer 121 to further penetrate through the second bonding layer 124.

The second substrate portion 120 may further include a second protective layer 125 disposed on the third insulating layer 121 to cover the second wiring layer 122. In this case, the second wiring layer 122 covered by the second protective layer 125 may be a first wiring layer 112 disposed on an outermost layer of the second substrate portion 120. However, the second wiring layer 122 disposed on the outermost layer may be covered by the second bonding layer 124 rather than the second protective layer 125, and for example, a second wiring layer 122 disposed on one side of the second wiring layer 122 disposed on the outermost side of the first substrate portion 120 may be covered by a second protective layer 125, and only the second wiring layer 122 disposed on the other side may be covered by the second bonding layer 124.

Meanwhile, as described above, the first substrate portion 110 may have a rigid region R and a flexible region F1, and the second substrate portion 120 may have a region, other than a region overlapping the first substrate portion, as a flexible region F2. Accordingly, the printed circuit board 100A according to an example may have a flexible region F1, a rigid region R, and a flexible region F2. As illustrated in FIG. 13, the flexible region F2 of the second substrate portion 120 may be bent, and if necessary, may be disposed inside an electronic device in a state in which the flexible region F2 of the second substrate portion 120 is bent. Therefore, a space occupied by the printed circuit board in the electronic device can be reduced, and the space limitations of the electronic device can be overcome.

Meanwhile, the first substrate portion 110 and/or the second substrate portion 120 may be implemented to minimize signal transmission loss, thereby reducing signal transmission loss, even in a high frequency region. For example, an antenna, or the like, may be mounted on the second substrate portion 120 of the printed circuit board 100A, and if necessary, signal transmission loss in the second substrate portion 120, a region in which the antenna, or the like is mounted, may be implemented to be smaller than the signal transmission loss in the first substrate portion 110. In addition, the first substrate portion 110 may be implemented to compensate for signal transmission loss in the second substrate portion 120. In this case, the signal transmission loss in each of the first substrate portion 110 and the second substrate portion 120 may be adjusted by adjusting a dielectric constant Dk and/or a dielectric dissipation factor Df of at least one of the first insulating layer 111, the second insulating layer 115, the third insulating layer 121, the first bonding layer 113, and the second bonding layer 124.

Meanwhile, the first substrate portion 110 and the second substrate portion 120 may be connected by a first connection conductor 131, or the like. Therefore, the first substrate portion 110 and the second substrate portion 120 may not be integrally manufactured, but may be connected after each of the first substrate portion 110 and the second substrate portion 120 is separately manufactured, and thus connected. Thus, decrease in production costs and/or convenience in process may be achieved.

Hereinafter, each component of the printed circuit board 100A according to an example will be described in more detail.

The first substrate portion 110 has a flexible region F1 and a rigid region R. The first substrate portion 110 may include a first insulating layer 111, a second insulating layer 115, a first wiring layer 112, and a first via layer 113, and may further include a first bonding layer 114. The first substrate portion 110 may be electrically connected to another printed circuit board, such as a mainboard, wherein the flexible region F1 of the first substrate portion 110 may be connected to a mainboard or the like.

A material having insulating properties may be used as a material for forming the first insulating layer 111. An elastic modulus of the first insulating layer 111 may be smaller than an elastic modulus of the second insulating layer 115. Accordingly, the flexible region F1 in which only the first insulating layer 111 is disposed may have characteristics that are relatively more easily bent or folded than the rigid region R in which the first insulating layer 111 and the second insulating layer 115 are disposed. However, the first insulating layer 111 may include the same material as the second insulating layer 115, and the first insulating layer 111 may have a thinner thickness than the second insulating layer 115, such that the first insulating layer 111 may have characteristics of being relatively more easily bent or folded, compared to the second insulating layer 115.

As a material for forming the first insulating layer 111, in order to have characteristics of being more easily bent or folded, polyimide (PI), modified polyimide (MPI), liquid crystal polymer (LCP) polyethylene terephthalate (PET), polyethylene naphthalate (PEN), polycarbonate (PC), polyethersulfone (PES), polyacrylate (PAR), and the like, may be used. In addition, the first insulating layer 111 may not contain reinforcing materials such as glass fibers and/or fillers.

If necessary, as a material for forming the first insulating layer 111, a material capable of minimizing signal transmission loss in the first substrate portion 110 may be selected, similarly to a third insulating layer 121 described later. In addition, the same material as the forming material of the third insulating layer 121 may be included. In this regard, as a material for forming the first insulating layer 111, polyimide (PI), modified polyimide (MPI), liquid crystal polymer (LCP), polytetrafluoroethylene (PTFE), polyphenylene sulfide (PPS), polyphenylene ether (PPE), cycloolefin polymer (COP), polyether ether ketone (PEEK), or the like may be used, but the formation material of the first insulating layer 111 is not limited thereto.

The number of the first insulating layers 111 is not particularly limited, and may be a single first insulating layer 111 or a plurality of first insulating layers 111. When the first insulating layer 111 includes a plurality of first insulating layers 111, each material, thickness, or the like may be the same as each other, or may be different from each other.

The first wiring layer 112 may perform various functions according to a design of the corresponding layer. For example, each of the plurality of first wiring layers 112 may include a ground pattern, a power pattern, a signal pattern, or the like. In this case, the signal pattern may include various signals, except for the ground pattern, the power pattern, and the like, for example, an antenna signal, a data signal, or the like. Each of these patterns may include a line pattern, a plane pattern, and/or a pad pattern.

As a material for forming the first wiring layer 112, a conductive material may be used, and as a non-limiting example, copper (Cu), aluminum (Al), silver (Ag), tin (Sn), gold (Au), and nickel (Ni), lead (Pb), titanium (Ti), or alloys thereof may be used. The first wiring layer 112 may be formed by a known plating process, and thus may include a seed layer, an electroless plating layer, and an electrolytic plating layer, formed based on the seed layer.

The first via layer 113 may perform various functions according to the design of the corresponding layer. For example, the first via layer 113 may include a via for signal connection, a via for ground connection, a via for power connection, and the like.

A conductive material may also be used as the forming material of each of the first via layers 113, and as a non-limiting example, copper (Cu), aluminum (Al), silver (Ag), tin (Sn), gold (Au), and nickel (Ni), lead (Pb), titanium (Ti), or alloys thereof may be used. Each via included in each of the plurality of first via layers 113 may be those in which a metal material is completely filled in a via hole, or in which a metal material is formed along a wall surface of a via hole.

Each via included in each of the plurality of first via layers 113 may have a known shape such as a tapered shape, an hourglass shape, a cylindrical shape, or the like. When the via included in each of the plurality of first via layers 113 has a tapered shape, the via included in each of the plurality of first via layers 113 may have a shape tapered in the same direction, or have a shape tapered in an opposite direction, depending on the manufacturing process. In addition, when the via included in each of the plurality of first via layers 113 has a tapered shape, the via, the tapered direction of each the via may be deformed depending on the manufacturing process.

The first bonding layer 114 is disposed between the first insulating layers 111 to serve to attach the first insulating layers 111 to each other. As a material for forming the first bonding layer 114, an adhesive material that can be used for a printed circuit board can be used without limitation, and for example, the first bonding layer 114 may be a bonding sheet, but is not limited thereto. If necessary, the first bonding layer 114 may include a material having a low dielectric dissipation factor in terms of signal transmission loss.

The number of the first bonding layers 114 may be changed according to the number of the first insulating layers 111. When the first bonding layer 114 includes a plurality of first bonding layers 114, each material, thickness, or the like may be the same as each other, or may be different from each other.

A material for forming the second insulating layer 115 is not particularly limited. For example, a thermosetting resin such as an epoxy resin, a thermoplastic resin such as a polyimide resin, a material including a reinforcing material such as a glass fiber and/or a filler, for example, prepreg, Ajinomoto Build-up Film (ABF), Photo Imageable Dielectric (PID), or the like, may be used. If necessary, as the material for forming the second insulating layer 115, the same material as the material for forming the first insulating layer 111 may be used.

The number of the second insulating layers 115 is not particularly limited, and may be a single second insulating layer 115 or a plurality of second insulating layers 115. When the second insulating layer 115 includes a plurality of second insulating layers 115, each material, thickness, or the like may be the same as each other, or may be different from each other. When the second insulating layer 115 is disposed on both surfaces of the first insulating layer 111, the number of the second insulating layer 115 disposed on each of one surface and the other surface of the first insulating layer 111 may be mutually different from each other.

The cover lay 116 may be disposed on the first insulating layer 111 in the flexible region F1 to protect the first wiring layer 112. As a material for forming the cover lay 116, polyimide (PI), liquid crystal polymer (LCP), teflon, or the like, may be used, and the material for forming the cover lay 116 may be formed of the same material as the first insulating layer 111. The cover lay 116 may be a film type or a liquid type.

The first protective layer 117 may be disposed on the second insulating layer 115 in the rigid region R to protect the first wiring layer 112. The first protective layer 117 may have an opening exposing at least a portion of the first wiring layer 112 disposed on the outermost layer in the rigid region R. The first protective layer 117 may be an Ajinomoto Build-up Film (ABF) layer, or a solder resist (SR) layer. However, the present disclosure is not limited thereto, and a known insulating material may be used as a material for forming the first protective layer 117 without limitation.

The second substrate portion 120 may include a third insulating layer 121, a second wiring layer 122, and a second via layer 123, and may further include a second bonding layer 124.

The third insulating layer 121 may have a characteristic of being more easily bent or folded. As a material for forming the third insulating layer 121, in order to have the characteristic of being more easily bent or folded, polyimide (PI), modified polyimide (MPI), liquid crystal polymer (LCP), polyethylene terephthalate (PET), polyethylene naphthalate (PEN), polycarbonate (PC), polyethersulfone (PES), polyacrylate (PAR), or the like, may be used. In addition, the third insulating layer 121 may not include reinforcing materials such as glass fiber (glass cloth, glass fabric) and/or a filler, or the like.

Meanwhile, a material capable of minimizing signal transmission loss in the second substrate portion 120 may be selected as a material for forming the third insulating layer 121. In this regard, a dielectric dissipation factor (Df) of the third insulating layer 121 may be lower than a dielectric dissipation factor of the first insulating layer 111 and/or the second insulating layer 115. For example, as the forming material of the third insulating layer 121, polyimide (PI), modified polyimide (MPI), liquid crystal polymer (LCP), polytetrafluoroethylene; PTFE), polyphenylene sulfide (PPS), polyphenylene ether (PPE), cyclo olefin polymer (COP), polyether ether ketone (PEEK), or the like, may be used, but the material for forming the third insulating layer 121 is not limited thereto.

The number of the third insulating layers 121 is not particularly limited, and may be a single third insulating layer 121 or a plurality of third insulating layers 121. When the third insulating layer 121 includes a plurality of third insulating layers 121, each material, thickness, or the like may be the same as each other, or may be different from each other.

The second wiring layer 122 may perform various functions according to a design of the corresponding layer. For example, each of the plurality of second wiring layers 122 may include a ground pattern, a power pattern, a signal pattern, or the like. In this case, the signal pattern may include various signals, except for the ground pattern, the power pattern, and the like, for example, an antenna signal, a data signal, or the like. Each of these patterns may include a line pattern, a plane pattern, and/or a pad pattern.

As a material for forming each of the plurality of second wiring layers 122, a conductive material may be used. As a non-limiting example, copper (Cu), aluminum (Al), silver (Ag), tin (Sn), gold (Au), nickel (Ni), lead (Pb), titanium (Ti), or alloys thereof, or the like may be used. The second wiring layers 122 may be formed by a known plating process, and thus may include a seed layer, an electroless plating layer, and an electrolytic plating layer formed based on the seed layer.

The second via layers 123 may perform various functions according to a design of the corresponding layer. For example, the second via layer 123 may include a via for signal connection, a via for ground connection, a via for power connection, or the like.

A conductive material may also be used as a material for forming each of the plurality of second via layers 123, and, as a non-limiting example thereof, copper (Cu), aluminum (Al), silver (Ag), tin (Sn), gold (Au), nickel (Ni), lead (Pb), titanium (Ti), or alloys thereof, or the like may be used. A via included in each of the plurality of second via layers 123 may be those in which a metal material is completely filled in a via hole, or in which a metal material is formed along a wall surface of a via hole.

The via included in each of the plurality of second via layers 123 may have a known shape such as a tapered shape, an hourglass shape, a cylindrical shape, or the like. When the via included in each of the plurality of second via layers 123 has a tapered shape, the via included in each of the plurality of second via layers 123 may have a shape tapered in the same direction, or have a shape tapered in an opposite direction, depending on the manufacturing process. In addition, when the via included in each of the plurality of second via layers 123 has a tapered shape, the via, the tapered direction of each the via may be deformed depending on the manufacturing process.

The second bonding layer 124 may be disposed between the third insulating layers 121 to serve to attach the third insulating layers 121 to each other. As a material for forming the second bonding layer 124, an adhesive material that can be used for a printed circuit board can be used without limitation, and for example, the second bonding layer 124 may be a bonding sheet, but it is not limited thereto. If necessary, the second bonding layer 124 may include a material having a low dielectric dissipation factor in terms of signal transmission loss.

The number of second bonding layers 124 may be changed according to the number of second insulating layers 115. When the second bonding layer 124 includes a plurality of second bonding layers 124, materials, thickness, or the like of each of the plurality of second bonding layers 124 may be the same, or may be different from each other.

The second protective layer 125 may be disposed on the third insulating layer 121 to protect the second wiring layer 122. The second protective layer 125 may have an opening exposing at least a portion of the second wiring layer 122 disposed on an outermost layer. The second protective layer 125 may be an Ajinomoto Build-up Film (ABF) layer, or a solder resist (SR) layer. However, the present disclosure is not limited thereto, and a known insulating material may be used without limitation as a material for forming the second protective layer 125.

The first connection conductor 131 may serve to physically and electrically connect the first substrate portion 110 and the second substrate portion 120. The first connection conductor 131 may be a solder ball, but is not limited thereto.

The electronic component 141 may be an active component and/or a passive component. For example, the electronic component 141 may be an integrated circuit IC of a radio-frequency integrated circuit (RFIC), or the like, and may be a passive component such as a multi layer ceramic capacitor (MLCC), a power inductor (PI), or the like. The electronic component 141 may be connected to the first wiring layer 112 of the first substrate portion 110, and may also be connected to the second wiring layer 122 of the second substrate portion 120 through the first wiring layer 112.

The second connection conductor 142 may serve to physically and electrically connect the first substrate portion 110 and the electronic component 141. The second connection conductor 142 may be a solder ball, but is not limited thereto.

The encapsulant 143 may serve to seal and protect the electronic component 141. A material for forming the encapsulant 143 is not particularly limited as long as it is a heat insulating material, but an Ajinomoto Build-up Film (ABF) or the like, may be used, and if necessary, a Photo Imageable Encapsulant (PIE) may also be used.

Figure 4:
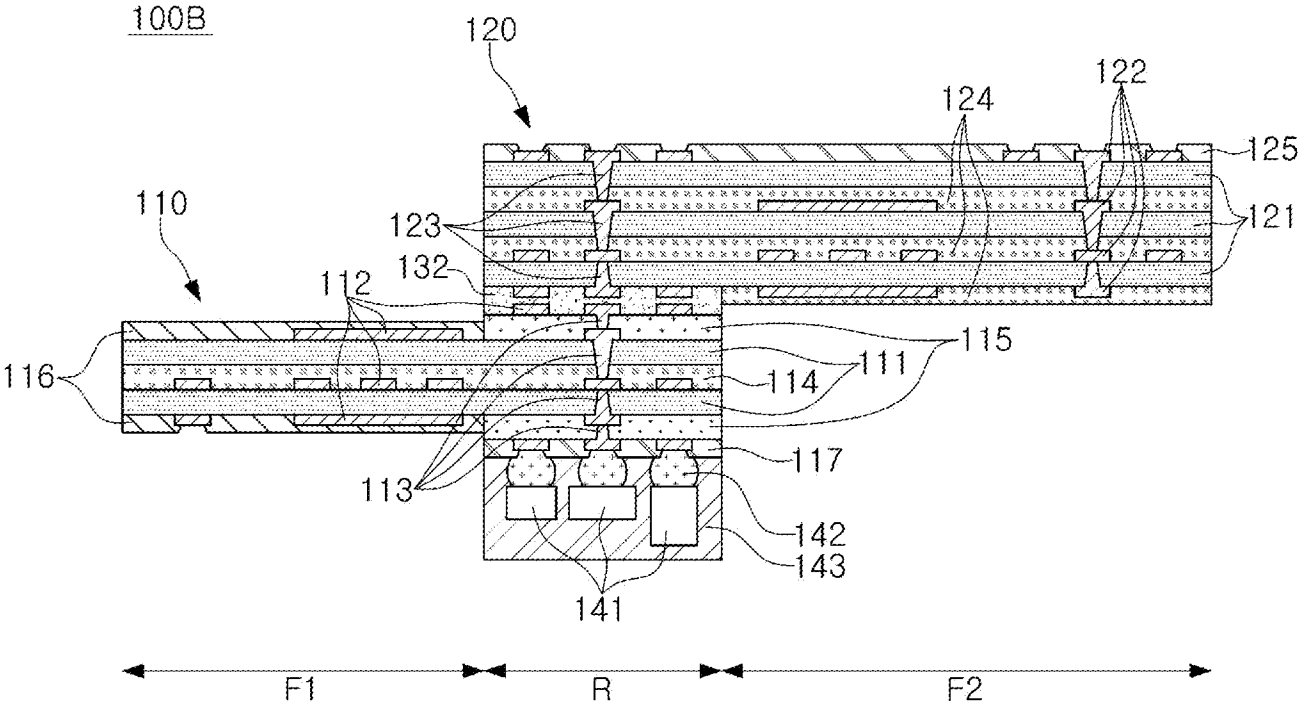
FIG. 4 is a cross-sectional view schematically illustrating another example of a printed circuit board according to the present disclosure.

FIG. 4 is a cross-sectional view illustrating another example of a printed circuit board according to the present disclosure.

Referring to FIG. 4, unlike the printed circuit board 100A according to an example, in a printed circuit board 100B according to another example, a first substrate portion 110 and a second substrate portion 120 are connected to each other through a conductive bonding layer 132. Accordingly, the first wiring layer 112 of the first substrate portion 110 and the second wiring layer 122 of the second substrate portion 120 may be electrically connected to each other through the conductive bonding layer 132.

As illustrated in FIG. 4, in a region in which the conductive bonding layer 132 is disposed, a first protective layer 117 may not be disposed on the first substrate portion 110 and a second bonding layer 124 may not be disposed on the second substrate portion 120.

The conductive bonding layer 132 may be an anisotropic conducive film (ACF).

When the first substrate portion 110 and the second substrate portion 120 are connected through the conductive bonding layer 132, even when the first wiring layer 112 and/or the second wiring layer 122 has a fine pitch, a connection between the first wiring layer 112 and the second wiring layer 122 may be easy. In addition, signal transmission loss between the first substrate portion 110 and the second substrate portion 120 may be reduced, compared to the case in which the first substrate portion 110 and the second substrate portion 120 are connected through a connection conductor such as a solder ball, or the like.

Other contents are substantially the same as described above in the description of the printed circuit board 100A according to an example, and a detailed description thereof is omitted.

Figure 5:
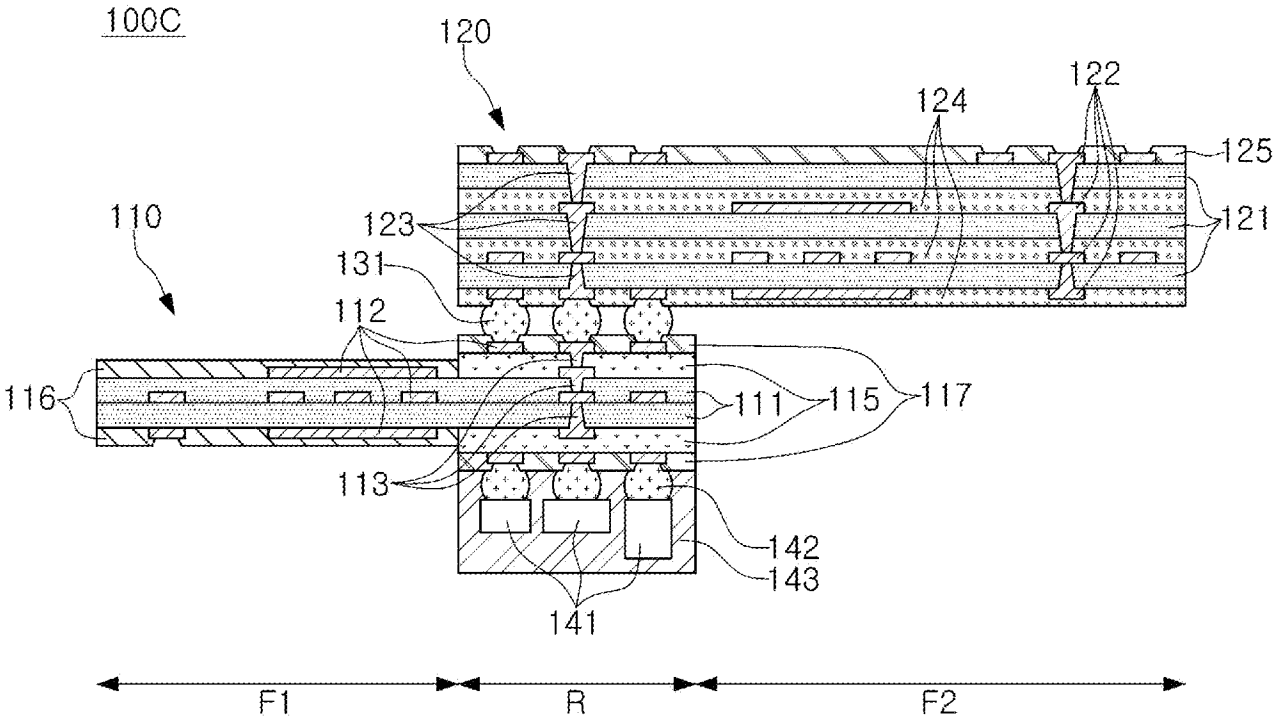
FIG. 5 is a cross-sectional view schematically illustrating another example of a printed circuit board according to the present disclosure.

FIG. 5 is a cross-sectional view schematically illustrating another example of a printed circuit board according to the present disclosure.

Referring to FIG. 5, unlike the printed circuit board 100A according to an example, in a printed circuit board 100C according to another example, the first substrate portion 110 does not include the first bonding layer 114 of FIG. 3.

Depending on a material for forming the first insulating layer 111, a plurality of first insulating layers 111 may be stacked to contact each other, and a bonding layer may not be required between the plurality of first insulating layers 111.

Other contents are substantially the same as described above in the description of the printed circuit board 100A according to an example thereof, and a detailed description thereof is omitted.

Figure 6:
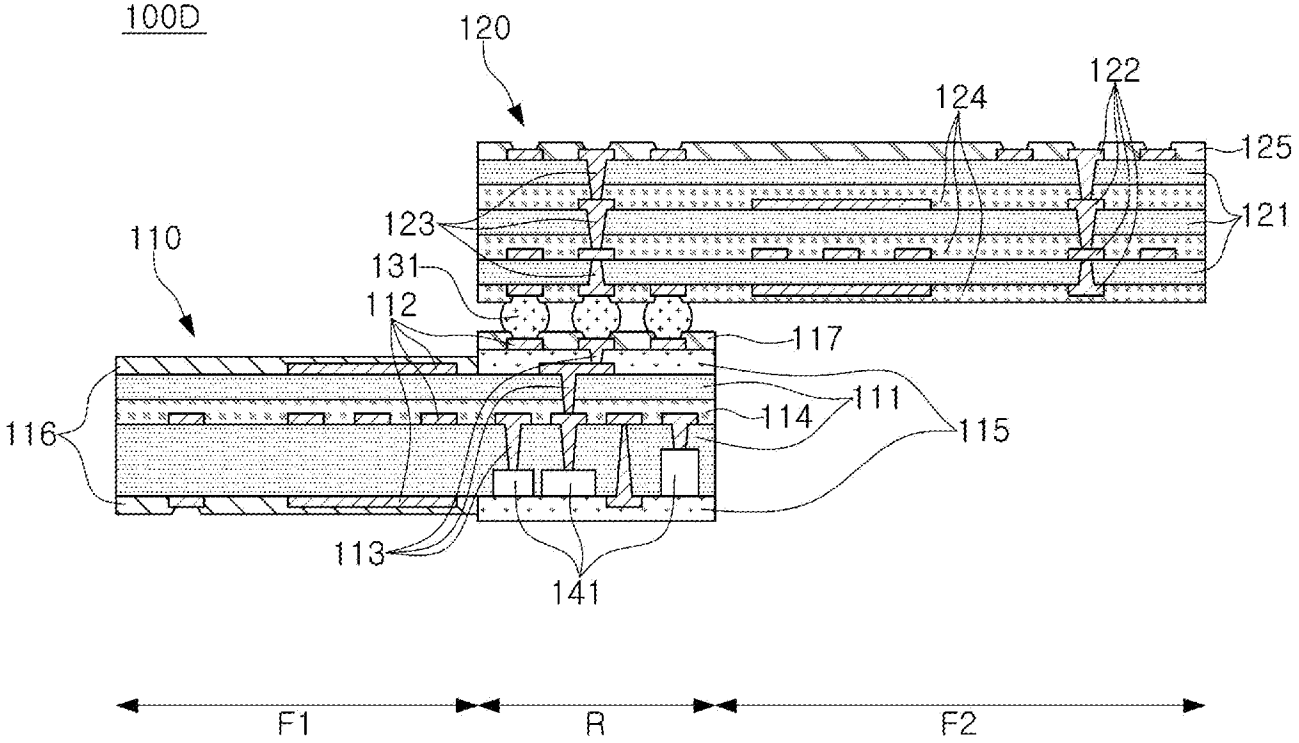
FIG. 6 is a cross-sectional view schematically illustrating another example of a printed circuit board according to the present disclosure.

FIG. 6 is a cross-sectional view schematically illustrating another example of a printed circuit board according to the present disclosure.

Referring to FIG. 6, unlike the printed circuit board 100A according to one example, in a printed circuit board 100D according to another example, an electronic component 141 is embedded in the rigid region R of the first substrate portion 110.

The electronic component 141 may be embedded in the first insulating layer 111 of the first substrate portion 110, but is not limited thereto. For example, alternatively, the electronic component 141 may be embedded in the second insulating layer 115 of the first substrate portion 110, or may be embedded in the plurality of first insulating layers 111 and/or the plurality of second insulating layers 115. For another example, depending on the design, the electronic component 141 may be embedded in the first bonding layer 114.

In the case of the printed circuit board 100D according to another example, since the electronic component 141 is embedded in the first substrate portion 110, an overall thickness of the printed circuit board can be reduced. In addition, an antenna or the like may be disposed on the second substrate portion 120 of the printed circuit board as described below, and in this case, a signal path between the antenna and the electronic component 141 may be shortened.

Other contents are substantially the same as described above in the description of the printed circuit board according to an example thereof, and a detailed description thereof is omitted.

Figure 7:
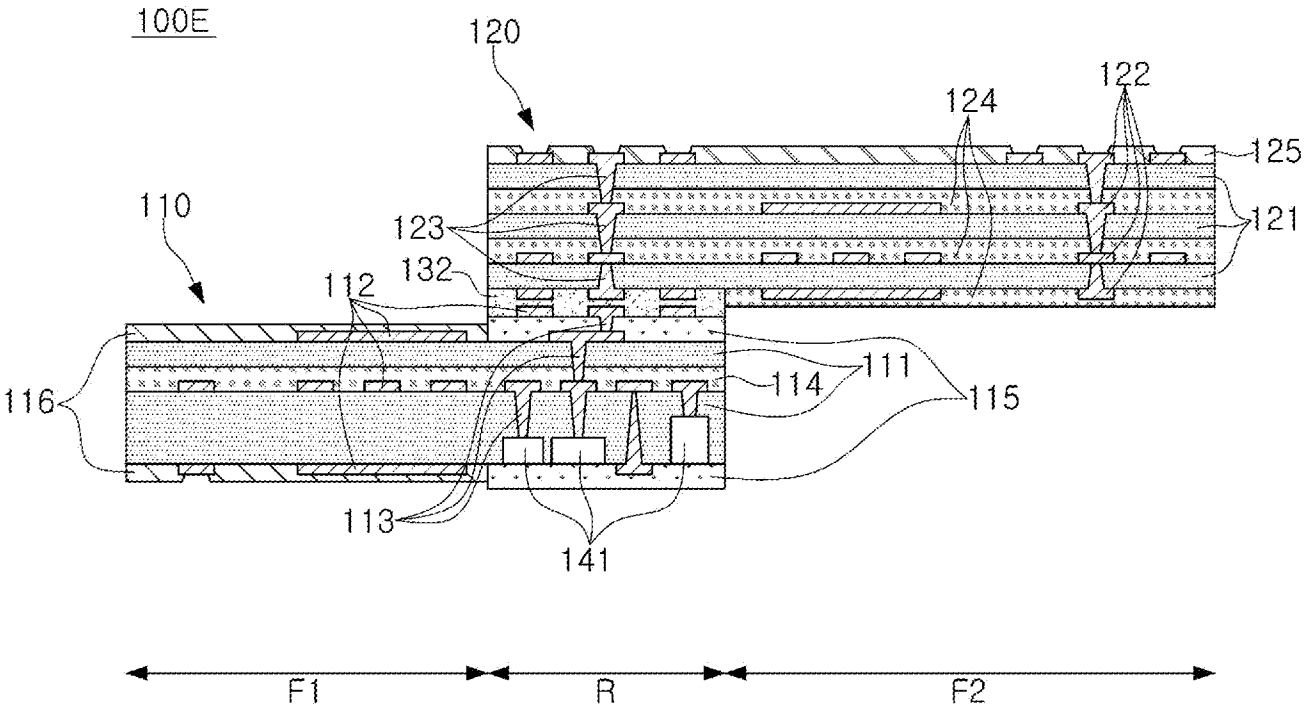
FIG. 7 is a cross-sectional view schematically illustrating another example of a printed circuit board according to the present disclosure.

FIG. 7 is a cross-sectional view schematically illustrating another example of a printed circuit board according to the present disclosure.

Referring to FIG. 7, unlike the printed circuit board 100D according to another example, in a printed circuit board 100E according to another example, the first substrate portion 110 and the second substrate portion 120 are connected to each other through a conductive bonding layer 132. Therefore, the first wiring layer 112 of the first substrate portion 110 and the second wiring layer 122 of the second substrate portion 120 may be electrically connected to each other through the conductive bonding layer 132.

As illustrated in FIG. 7, in a region in which the conductive bonding layer 132 is disposed, a first protective layer 117 may not be disposed on the first substrate portion 110 and a second bonding layer 124 may not be disposed. For example, the first protective layer 117, applied in the printed circuit board 100D according to another example, may be omitted in the printed circuit board 100E according to another example, and a portion of the second bonding layer 124 facing the first protective layer 117 in the printed circuit board 100D according to another example, may be omitted in the printed circuit board 100E according to another example.

The conductive bonding layer 132 may be an anisotropic conductive film (ACF).

When the first substrate portion 110 and the second substrate portion 120 are connected through the conductive bonding layer 132, even when the first wiring layer 112 and/or the second wiring layer 122 has a fine pitch, a connection between the first wiring layer 112 and the second wiring layer 122 may be easy. In addition, a signal transmission loss between the first substrate portion 110 and the second substrate portion 120 may be reduced.

Other contents are substantially the same as described above in the description of the printed circuit board 100D according to an example thereof, and a detailed description thereof is omitted.

Figure 8:
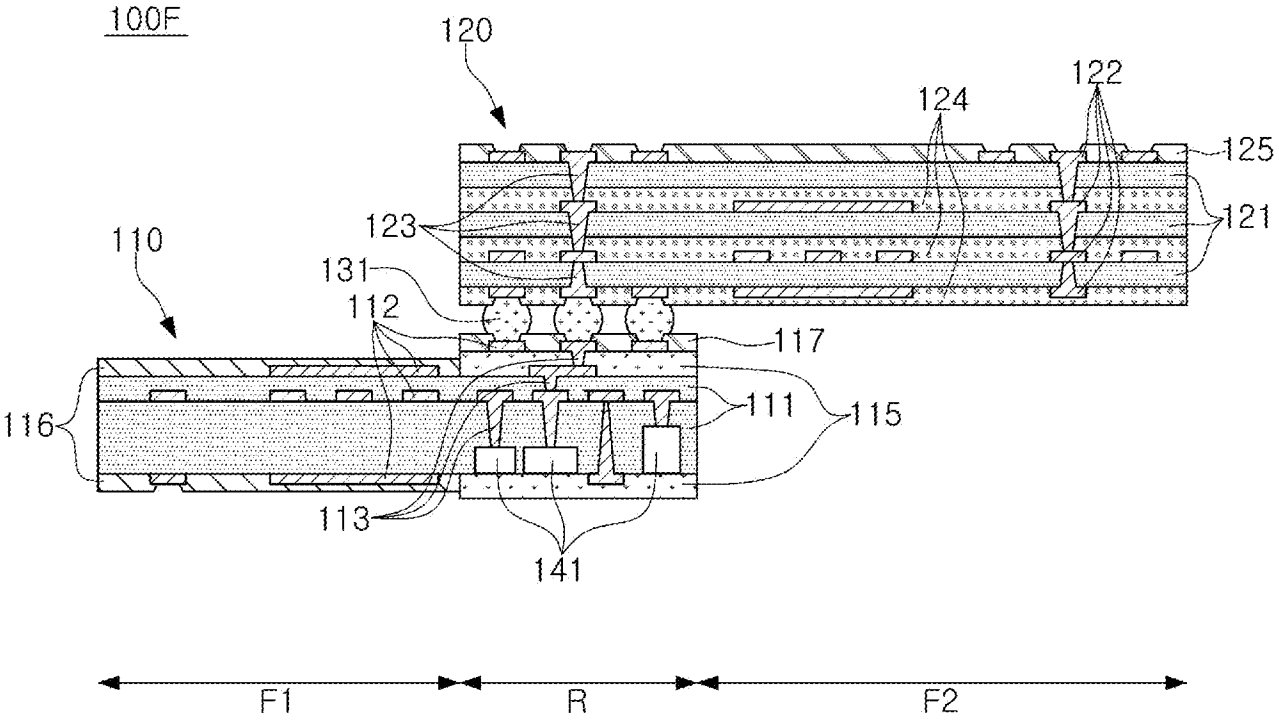
FIG. 8 is a cross-sectional view schematically illustrating another example of a printed circuit board according to the present disclosure.

FIG. 8 is a cross-sectional view illustrating another example of a printed circuit board according to the present disclosure.

Referring to FIG. 8, unlike the printed circuit board 100D according to another example, in a printed circuit board 100F according to another example, the first substrate portion 110 does not include the first bonding layer 114 of FIG. 6.

Depending on the material for forming the first insulating layer 111, the plurality of first insulating layers 111 may be stacked to contact each other, and a bonding layer may not be required between the plurality of first insulating layers 111.

Other contents are substantially the same as described above in the description of the printed circuit board 100D according to another example, and detailed descriptions thereof will be omitted.

Figure 9:
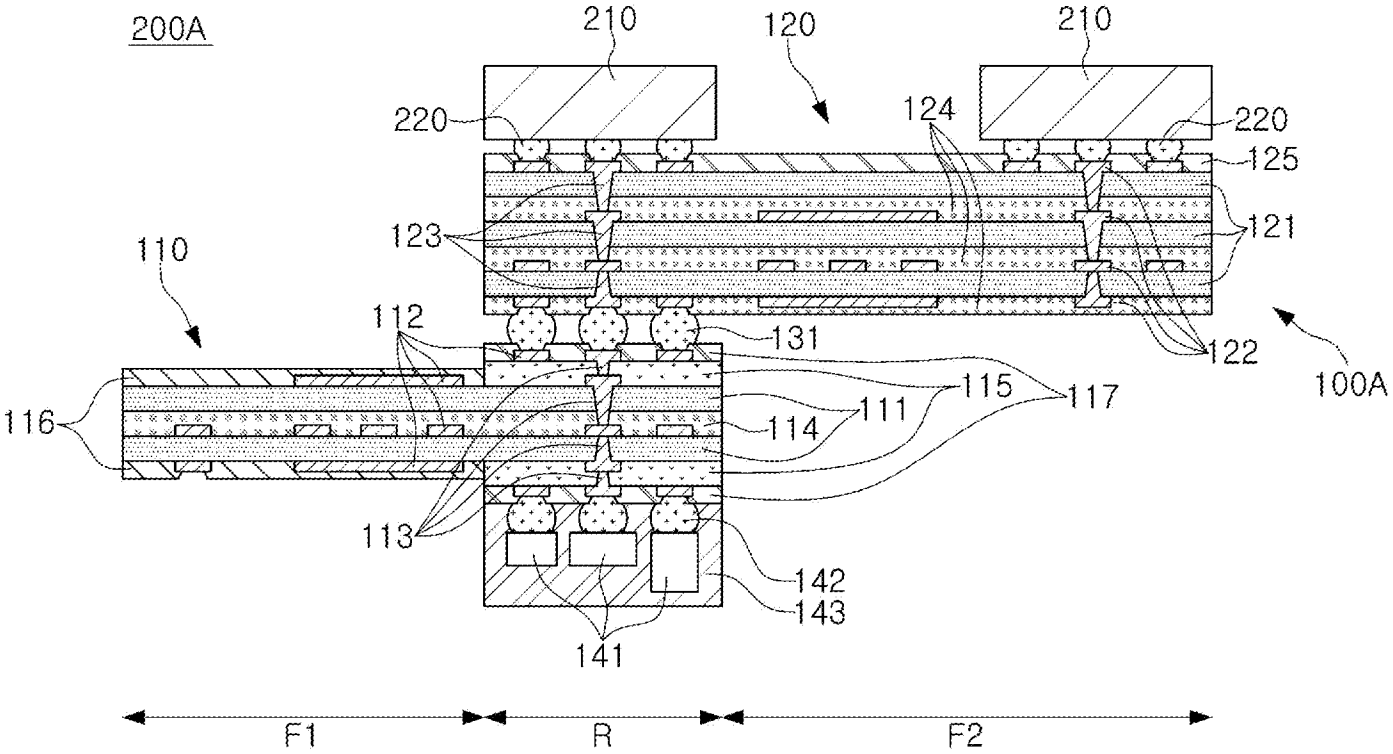
FIG. 9 is a cross-sectional view schematically illustrating an example of an antenna module according to the present disclosure.

FIG. 9 is a cross-sectional view schematically illustrating an example of an antenna module according to the present disclosure.

Referring to FIG. 9, an antenna module 200A according to an example includes a printed circuit board 100A, an antenna 210 disposed on the printed circuit board 100A, and a third connection conductor 220 connecting the printed circuit board 100A and the antenna 210.

As shown in FIG. 9, the antenna 210 may be disposed on an opposite side of a side of the second substrate portion 120, facing the first substrate portion 110. In addition, the antenna 210 may be a plurality of antennas 210, a portion of the plurality of antennas 210 may be disposed in a region overlapping the first substrate portion 110 of the second substrate portion 120 in a stacking direction of the first and second substrate portions 110 and 210, and another portion of the plurality of antennas 210 may be disposed in a flexible region F2 that is a region, other than the region overlapping the first substrate portion 110 of the second substrate portion 120.

The description of the printed circuit board 100A is substantially the same as described above in the description of the printed circuit board 100A according to the example of FIG. 3, and detailed descriptions thereof are omitted.

The antenna 210 may be a chip antenna, but is not limited thereto. If necessary, the antenna 200 may be a patch antenna or the like. In addition, if necessary, other electronic components may be mounted together with the antenna 210 on the printed circuit board 100A.

A third connection conductor 220 may serve to physically and electrically connect the antenna 210 and the second substrate portion 120. The third connection conductor 220 may be a solder ball, but is not limited thereto.

Figure 10:
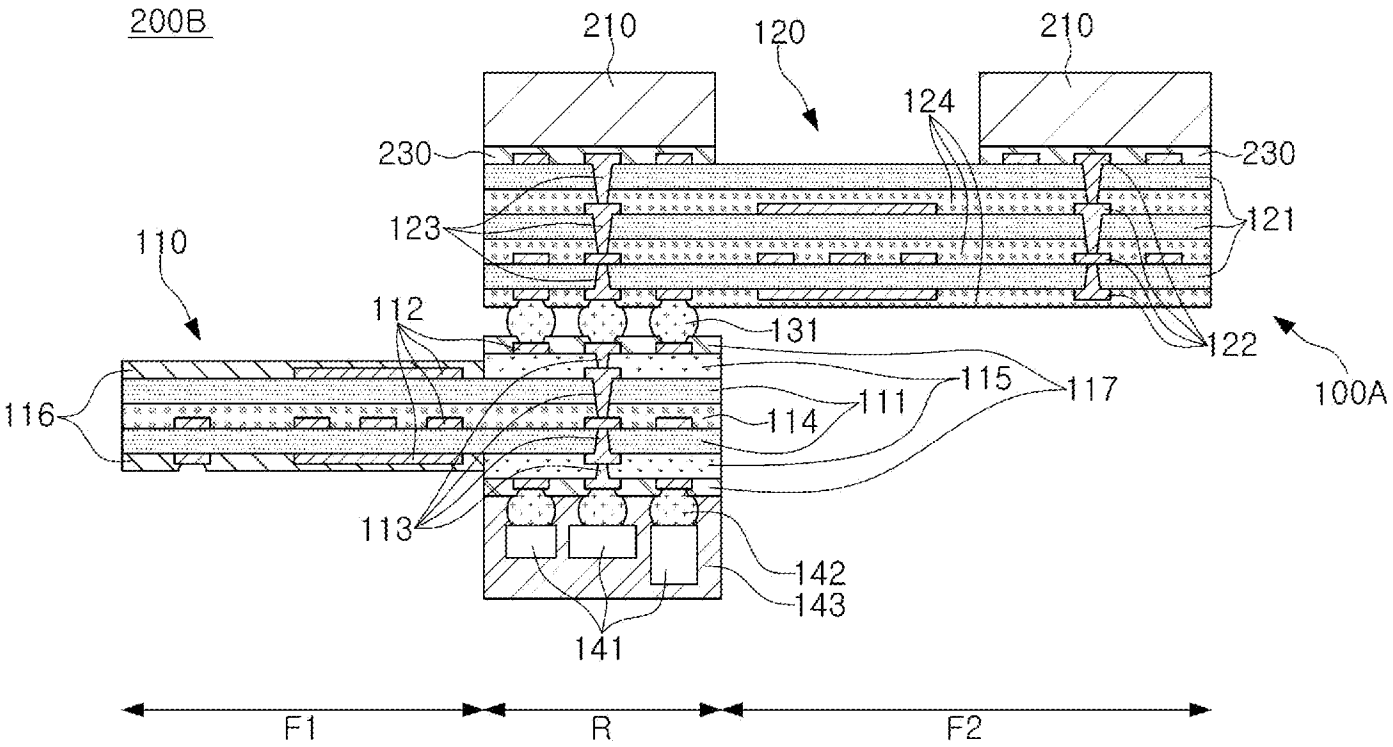
FIG. 10 is a cross-sectional view schematically illustrating another example of an antenna module according to the present disclosure.

FIG. 10 is a cross-sectional view illustrating another example of an antenna module according to the present disclosure.

Referring to FIG. 10, unlike the antenna module 200A according to another example, in an antenna module 200B, the antenna 210 and the second substrate portion 120 are connected to each other through a conductive bonding layer 230.

The conductive bonding layer 230 may be an anisotropic conductive film (ACF).

When the antenna 210 and the second substrate portion 120 are connected through the conductive bonding layer 230, even when a circuit pattern and/or a second wiring layer 122 included in the antenna 210 has a fine pitch, the connection between the antenna 210 and the second substrate portion 120 may be easy. In addition, it may have an effect of reducing signal transmission loss between the antenna 210 and the second substrate portion 120.

Other contents are substantially the same as described above in the description of the antenna module 200A according to an example, and detailed descriptions thereof are omitted.

Figure 11:
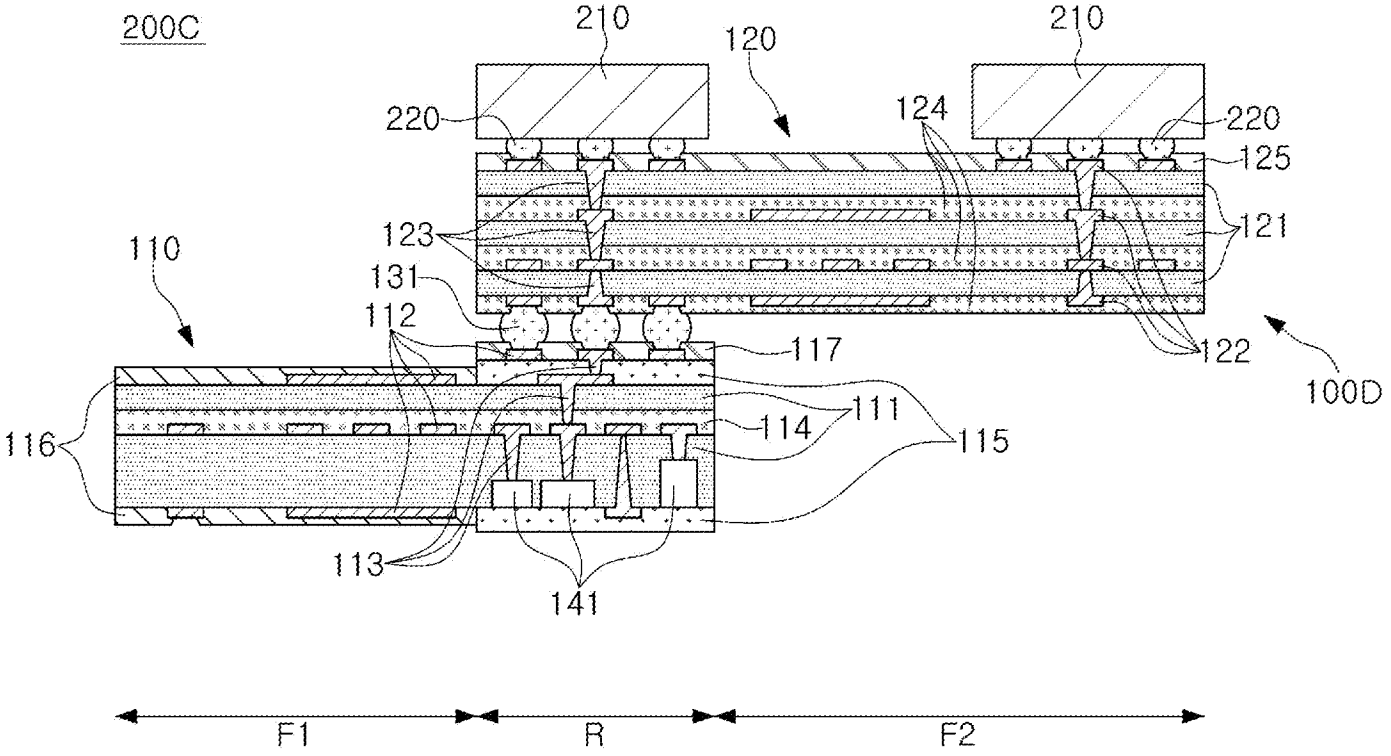
FIG. 11 is a cross-sectional view schematically illustrating another example of an antenna module according to the present disclosure.

FIG. 11 is a cross-sectional view illustrating another example of an antenna module according to the present disclosure.

Referring to FIG. 11, unlike the antenna module 200A according to another example, in an antenna module 200C according to another example, the printed circuit board included in the antenna module has a structure of the printed circuit board 100D illustrated in FIG. 4. However, this is for illustrating that the printed circuit board included in the antenna module may have various structures, and the structure of the printed circuit board included in the antenna module is not limited thereto.

Other contents are substantially the same as described above in the description of the antenna module 200A according to an example, and a detailed description thereof is omitted.

Although not shown in the drawings, an antenna 210 may be disposed on the other printed circuit boards, similar to the example shown in FIG. 9, FIG. 10, or FIG. 10.

Figure 12:
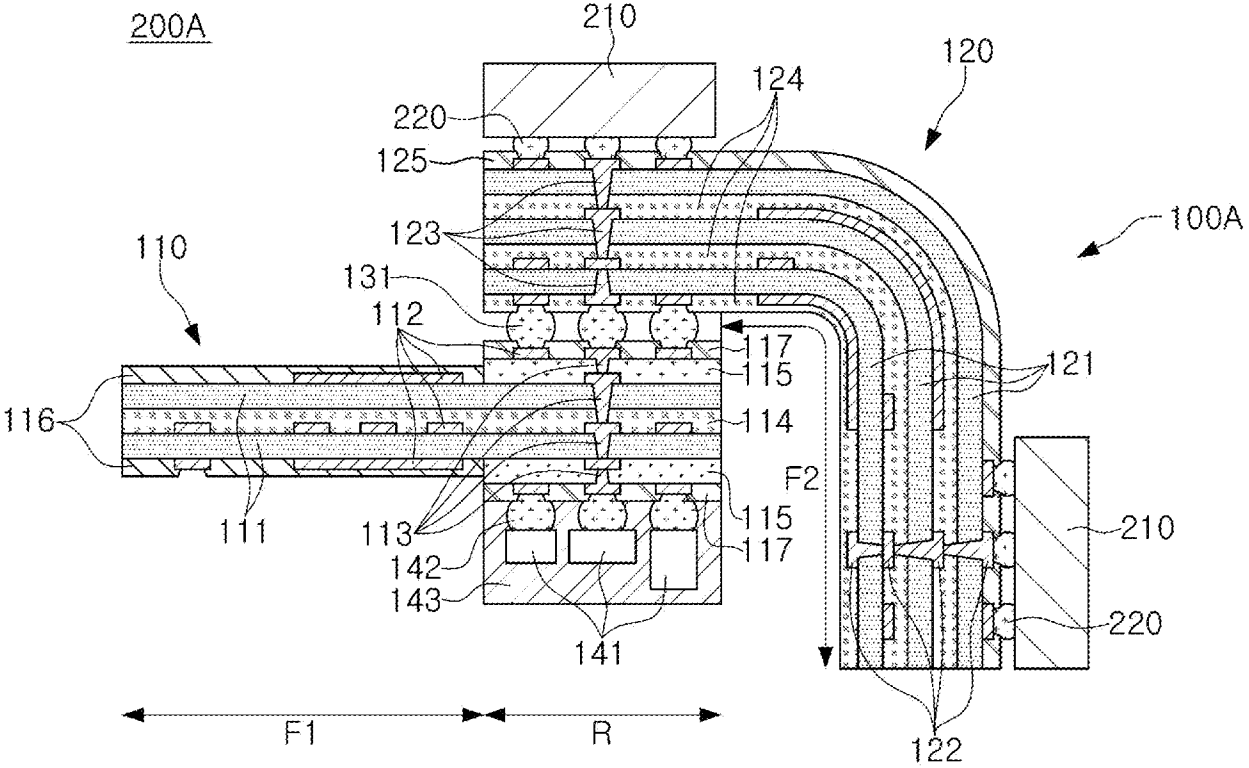
FIG. 12 is a cross-sectional view schematically illustrating an example of a bent state of an antenna module according to the present disclosure.

FIG. 12 is a cross-sectional view schematically illustrating an example of a bent state of an antenna module according to the present disclosure.

Referring to FIG. 12, a flexible region F2 of the second substrate portion 120 of the printed circuit board 100A included in the antenna module may be bent, and if necessary, the flexible region F2 of the second substrate portion 120 may be disposed inside the electronic device in a curved state. Therefore, the space occupied by the printed circuit board in the electronic device can be reduced, and the space limitations of the electronic device can be overcome. For example, as illustrated in FIG. 12, the flexible region F2 of the second substrate portion 120 may be bent in a direction opposite to a side of the second substrate portion 120 on which the antenna 210 is disposed.

As set forth above, as one effect among various effects of the present disclosure, a printed circuit board capable of overcoming the space limitations of electronic devices may be provided.

As another effect among various effects of the present disclosure, a printed circuit board capable of minimizing signal transmission loss may be provided.

As another effect among various effects of the present disclosure, a printed circuit board capable of reducing costs and/or convenience of a process may be provided.

As another effect among various effects of the present disclosure, an antenna module capable of miniaturizing a product may be provided.

As another effect among various effects of the present disclosure, an antenna module capable of minimizing signal transmission loss may be provided.

As another effect among various effects of the present disclosure, an antenna module capable of reducing costs and/or convenience of a process may be provided.

In the present disclosure, the terms "upper," "uppermost," "lower," "lowermost," "left," and "right" may be used based on the drawings. However, the terms are for convenience of description, and are not intended to limit a specific direction.

As used herein, the term "connect" or "connection" in the present specification may be not only a direct connection, but also a concept including an indirect connection. In addition, the term "electrically connected" or "electrical connection" in the present specification is a concept including both a physical connection and a physical non-connection.

In the present specification, the expressions of "first," second," etc. in the present specification are used to distinguish one component from another, and do not limit the order and/or importance of the components. In some cases, without departing from the spirit of the present disclosure, a "first" component may be referred to as a "second" component, and similarly, a "second" component may be referred to as a "first" component.

The expression "example" used in this specification does not refer to the same embodiment to each other, but may be provided for emphasizing and explaining different unique features. However, the above-mentioned examples do not exclude that the above-mentioned examples are implemented in combination with the features of other examples. For example, although the description in a specific example is not described in another example, it can be understood as an explanation related to another example, unless otherwise described or contradicted by the other example.

The terms used in the present disclosure are used only to illustrate various examples and are not intended to limit the present inventive concept. Singular expressions include plural expressions unless the context clearly dictates otherwise.

As an effect of the present disclosure, a printed circuit board capable of miniaturization and thinning of a product may be provided.

As an effect of the present disclosure, a printed circuit board capable of reducing signal transmission loss may be provided.

As an effect of the present disclosure, a printed circuit board including an antenna may be provided.

As an effect of the present disclosure, an antenna module capable of miniaturization and thinning of a product may be provided.

As an effect of the present disclosure, an antenna module capable of reducing signal transmission loss may be provided.

As an effect of the present disclosure, an antenna module including a plurality of antennas may be provided.

As an effect of the present disclosure, an antenna module capable of responding to frequencies of multiple bands may be provided.

While example embodiments have been illustrated and described above, it will be apparent to those skilled in the art that modifications and variations could be made without departing from the scope of the present disclosure as defined by the appended claims.

What is claimed is:

1. A printed circuit board, comprising:

a first substrate portion having a rigid region and a flexible region; and a second substrate portion disposed on the first substrate portion, wherein the first substrate portion and the second substrate portion are disposed to be shifted such that portions of each of the first substrate portion and the second substrate portion overlap each other, and wherein the first substrate portion and the second substrate portion are connected to each other through a conductive bonding layer.

2. The printed circuit board of claim 1, wherein a portion of the second substrate portion overlaps the rigid region of the first substrate portion.

3. The printed circuit board of claim 1, wherein a region of the second substrate portion, other than a region overlapping the first substrate portion, is flexible.

4. The printed circuit board of claim 1, wherein the flexible region of the first substrate portion comprises a first insulating layer and a first wiring layer disposed on the first insulating layer, wherein the rigid region of the first substrate portion comprises the first insulating layer, the first wiring layer, and a second insulating layer disposed on the first insulating layer to cover the first wiring layer, and an elastic modulus of the first insulating layer is lower than an elastic modulus of the second insulating layer.

5. The printed circuit board of claim 4, wherein the first insulating layer includes a plurality of first insulating layers, and the first substrate portion further comprises a first bonding layer disposed between the plurality of first insulating layers.

6. The printed circuit board of claim 1, further comprising an electronic component embedded in the rigid region of the first substrate portion.

7. The printed circuit board of claim 1, wherein the second substrate portion comprises an insulating layer, a wiring layer disposed on the insulating layer, and a bonding layer disposed on the insulating layer to cover the wiring layer.

8. The printed circuit board of claim 7, wherein a material of the insulating layer comprises at least one of a liquid polymer or a modified polyimide.

9. The printed circuit board of claim 1, further comprising an electronic component disposed on an opposite side of a side of the rigid region of the first substrate portion on which the second substrate portion is disposed.

10. The printed circuit board of claim 1, wherein the first substrate portion comprises a first insulating layer, the second substrate portion comprises a second insulating layer, and a dielectric dissipation factor of the second insulating layer is lower than a dielectric dissipation factor of the first insulating layer.

11. An antenna module, comprising:

a first substrate portion having a rigid region and a flexible region;

a second substrate portion disposed on the first substrate portion; and an antenna disposed on the second substrate portion, wherein the first substrate portion and the second substrate portion are disposed to be shifted such that portions of each of the first substrate portion and the second substrate portion overlap each other, wherein the antenna is disposed on an opposite side of a side of the second substrate portion, the side of the second substrate portion facing the first substrate portion, and wherein the antenna and the second substrate portion are connected to each other through a conductive bonding layer.

12. The antenna module of claim 11, wherein the antenna includes a chip antenna.

13. The antenna module of claim 11, wherein a region of the second substrate portion, other than a region overlapping the first substrate portion, is flexible, and the antenna is disposed in the flexible region of the second substrate portion.

14. The antenna module of claim 11, wherein the first substrate portion comprises a first insulating layer, the second substrate portion comprises a second insulating layer, and a dielectric dissipation factor of the second insulating layer is lower than a dielectric dissipation factor of the first insulating layer.

15. The antenna module of claim 11, further comprising an electronic component disposed in the rigid region of the first substrate portion.

16. An antenna module, comprising:

a first substrate portion having a rigid region and a flexible region extending from the rigid region;

a second substrate portion including a first region disposed on the rigid region and a second region extending from the first region;

a connection portion connecting the rigid region of the first substrate portion and the first region of the second substrate portion to each other, the second region of the second substrate portion and the flexible region of the first substrate being disposed on opposing sides of the connection portion; and an antenna disposed on the first region of the second substrate portion, wherein the first substrate portion including a first insulating layer disposed at least in the flexible region and a second insulating layer disposed only in the rigid region, and wherein an elastic modulus of the first insulating layer is smaller than an elastic modulus of the second insulating layer.

17. The antenna module of claim 16, wherein further comprising an electronic component disposed in the rigid region of the first substrate portion.

18. A printed circuit board, comprising:

a first substrate portion having a rigid region and a flexible region; and a second substrate portion disposed on the first substrate portion, wherein the first substrate portion and the second substrate portion are disposed to be shifted such that portions of each of the first substrate portion and the second substrate portion overlap each other, wherein the flexible region of the first substrate portion comprises a first insulating layer and a first wiring layer disposed on the first insulating layer, wherein the rigid region of the first substrate portion comprises the first insulating layer, the first wiring layer, and a second insulating layer disposed on the first insulating layer to cover the first wiring layer, and wherein an elastic modulus of the first insulating layer is lower than an elastic modulus of the second insulating layer.

19. A printed circuit board, comprising:

a first substrate portion having a rigid region and a flexible region; and a second substrate portion disposed on the first substrate portion, wherein the first substrate portion and the second substrate portion are disposed to be shifted such that portions of each of the first substrate portion and the second substrate portion overlap each other, wherein the first substrate portion comprises a first insulating layer, wherein the second substrate portion comprises a second insulating layer, and wherein a dielectric dissipation factor of the second insulating layer is lower than a dielectric dissipation factor of the first insulating layer.

20. An antenna module, comprising:

a first substrate portion having a rigid region and a flexible region;

a second substrate portion disposed on the first substrate portion; and an antenna disposed on the second substrate portion, wherein the first substrate portion and the second substrate portion are disposed to be shifted such that portions of each of the first substrate portion and the second substrate portion overlap each other, wherein the antenna is disposed on an opposite side of a side of the second substrate portion, the side of the second substrate portion facing the first substrate portion, wherein the first substrate portion comprises a first insulating layer, wherein the second substrate portion comprises a second insulating layer, and wherein a dielectric dissipation factor of the second insulating layer is lower than a dielectric dissipation factor of the first insulating layer.

* * * * *